United States Patent [19]

Bubley et al.

[11] Patent Number: 4,648,317

[45] Date of Patent: Mar. 10, 1987

[54] MANUALLY OPERATED SCREEN PRINTING APPARATUS

[75] Inventors: Henry J. Bubley, Deerfield; Alex Iaccino, Mount Prospect, both of Ill.

[73] Assignee: American Screen Printing Equipment Co., Chicago, Ill.

[21] Appl. No.: 731,856

[22] Filed: May 7, 1985

[51] Int. Cl.[4] ..... B05C 17/10; B41L 13/02

[52] U.S. Cl. ..... 101/123; 101/126

[58] Field of Search ..... 101/123, 126

[56] References Cited

U.S. PATENT DOCUMENTS

| | | | |
|---|---|---|---|
| 1,821,302 | 9/1931 | Gorner | 101/123 |
| 1,843,116 | 2/1932 | Aldcroftt | 101/123 |
| 2,061,679 | 11/1936 | Simonton | 101/126 |
| 2,775,194 | 12/1956 | Dubuit | 101/123 |
| 2,968,239 | 1/1961 | Zumbehl | 101/123 |
| 3,919,039 | 11/1975 | Rohner | 101/123 |
| 3,943,849 | 3/1976 | Vasilantone | 101/123 |

FOREIGN PATENT DOCUMENTS

| | | | |
|---|---|---|---|
| 3144435 | 5/1983 | Fed. Rep. of Germany | 101/123 |
| 1227640 | 3/1960 | France | 101/123 |
| 267404 | 3/1928 | Italy | 101/126 |
| 33590 | 9/1905 | Switzerland | 101/123 |
| 847857 | 9/1960 | United Kingdom | 101/126 |
| 1402421 | 8/1975 | United Kingdom | 101/123 |

*Primary Examiner*—Clyde I. Coughenour

*Attorney, Agent, or Firm*—Fitch, Even, Tabin & Flannery

[57] ABSTRACT

A manually operated silk screen printing apparatus having a printing bed and a chase overlying the printing bed for removably mounting a screen in alignment with the overlying printing bed. Preferably, a single ball-shaped handle or joystick is mounted on the top of the squeegee carriage for pushing or pulling to slide a squeegee carriage mounted on a lever arm over the center of the screen. The carriage travels on a three-point bearing arrangement with a guide or track surface on the lever arm. Flipping of the handle through an overcenter position reverses the squeegee and the carriage for the respective flood and print strokes. More specifically, the lever arm includes a generally horizontal guide track overlying the chase and extending approximately the length of the screen. The guide track is centered with respect to the chase and guides the carriage. The squeegee blade is centered in perpendicular relationship along its length to the guide track and is movable through a predetermined angle with respect to an axis perpendicular to the surface of the stencil screen for both the print and return stroke.

15 Claims, 4 Drawing Figures

MANUALLY OPERATED SCREEN PRINTING APPARATUS

This invention relates generally to a screen printing apparatus and, more specifically, to a new and improved manually-operated, squeegee mechanism in a screen printer.

BACKGROUND OF THE INVENTION

In known types of manually operated silk screen printing apparatus, a hand-held squeegee is used to distribute ink across the screen and to force the ink through the screen onto the item to be printed in the pattern dictated by an intelligence pattern formed on the screen. While hand-held squeegees are inexpensive, even experienced printers, particularly when tired or distracted, sometimes fail to maintain a uniform pressure across the length of the squeegee blade during the printing stroke, resulting in an uneven print quality. Further, with hand-held squeegees, it is difficult to duplicate exactly the squeegee print action from one print to the next so that occasionally even consecutively-made prints may be non-uniform in quality. This is particularly noticeable in moderately long production runs of large-sized jobs.

Currently, manual silk screen printing units have been developed in which the squeegee blade is mounted on an elongated lever arm that is pivotally mounted at one end and that extends across the screen. The other end of the lever arm is a free or handle end that allows upward or downward movement of a squeegee carried on the lever arm to engage or disengage the screen. The squeegee is mounted on a carriage slideable along the lever arm when pushed and pulled by the operator through a print and flood stroke across the screen. Typically, the squeegee is pivoted on the carriage and the operator grasps the top of the squeegee with a hand on opposite sides of the lever arm and the carriage. The operator balances the amount of downward force exerted by each hand on the top of the squeegee to maintain the squeegee level and to try to exert uniform pressure on opposite halves of the squeegee blade onto the screen. The operator also adjusts the angle of incidence of the squeegee manually and tries to maintain a relatively uniform angle during an entire printing or flood stroke. The operator is free to adjust this angle during the stroke or between strokes and often inadvertantly makes such adjustments. That is, the operator is free to swing the squeegee to any angle of incidence with the screen, with the higher, more vertical angles for the squeegee exerting more force onto the screen to push the ink through the screen than when the squeegee is swung more toward the horizontal. The operator flips the squeegee between its print and flood strokes to an inclined angle of incidence between the flood and print stokes. In a typical, multi-arm, manual textile printer illustrated herein, the operator prints with the squeegee's lower end tilted away from the operator at the end of the level arm. At the end of the print stroke the operator turns the squeegee to an opposite inclination, with the lower end of the squeegee closer to the operator who is pushing the squeegee radially inwardly along the lever arm. Operators often have problems adjusting and maintaining this angle of incidence.

Manual operated silk screen printers are low in cost compared to automatic motor driven printers and any changes therein to produce better quality of printing or higher rates of production must be cost competitive to be commercially successful. Production from a manual silk screen printing press can be increased with the present invention by reducing the number of failures to achieve the quality of print needed and by reducing operator fatigue.

Accordingly, it is the primary object of the present invention to provide an improved, manual screen printing apparatus of the foregoing kind.

More particularly, it is an object to provide such an apparatus which is compact in size so as to be readily usable for printing small areas.

It is a further object to provide a manual screen printing apparatus that provides smooth, even and repeatable squeegee action across the screen which reduces operator fatigue and increases production from the apparatus.

Other objects and advantages will become apparent upon reference to the drawing and the detailed description of the preferred embodiment.

DETAILED DESCRIPTION OF THE PREFERRED EMBODIMENT

The present invention is herein described in connection with a multi-arm textile printing apparatus often used to print T-shirts or the like. The manually operated squeegee mechanism may be incorporated into various other silk screen printing apparatus that fall within the purview of the invention herein claimed.

Figure 1:
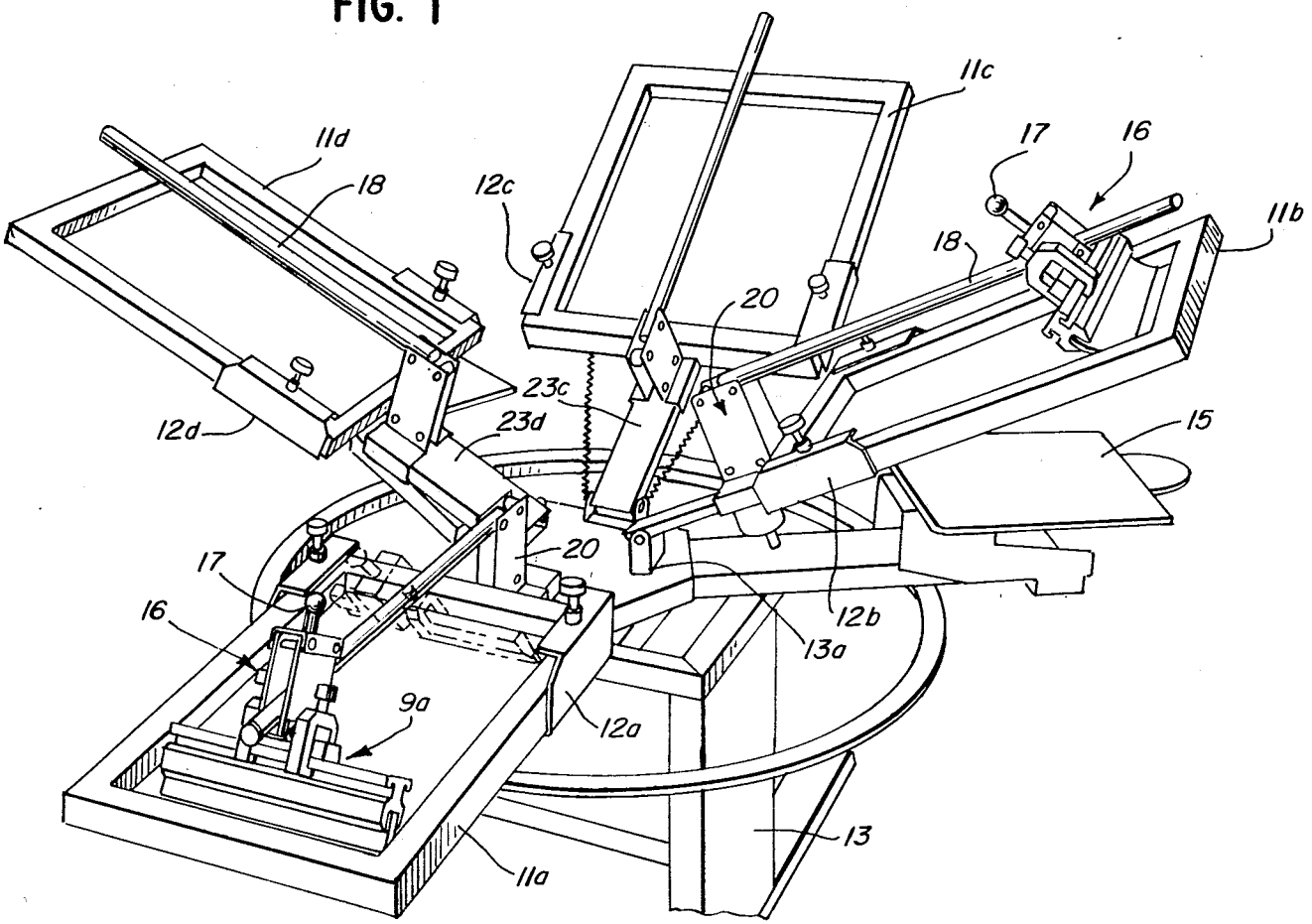
FIG. 1 is a perspective view of a screen printing apparatus embodying the present invention in place on a manual, multi-color textile printer.
Figure 2:
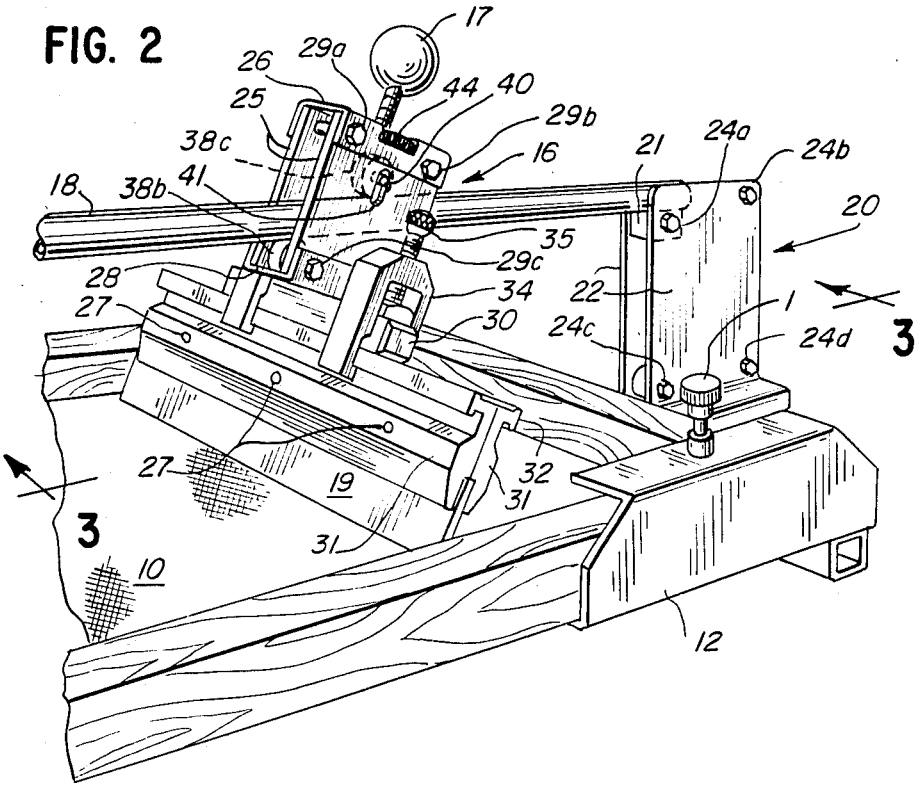
FIG. 2 shows a perspective view of a one-man screen printing apparatus in accordance with the present invention.
Figure 3:
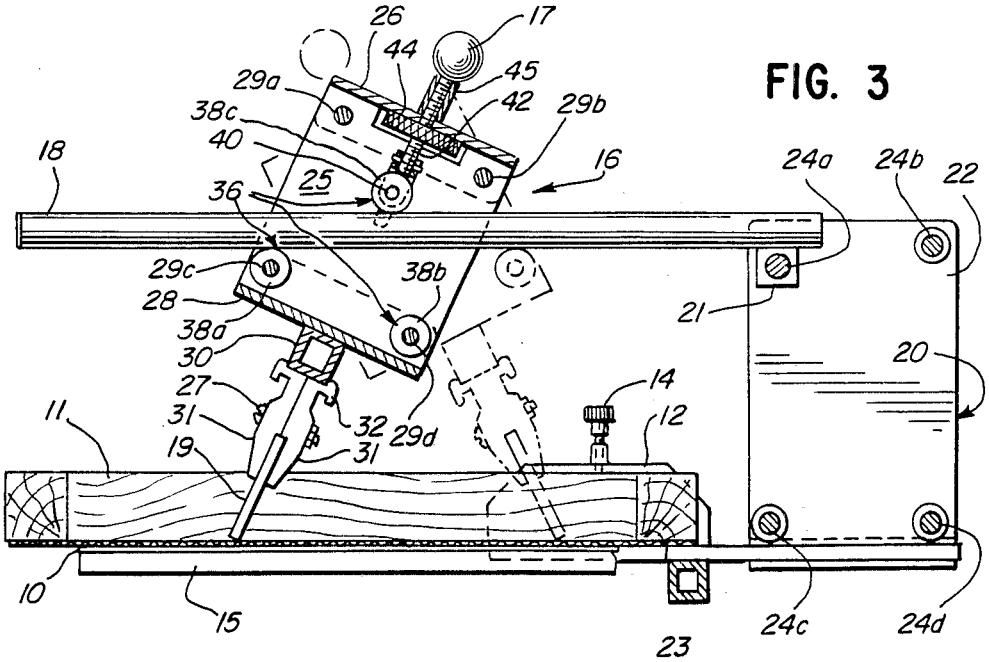
FIG. 3 is a side elevation of the screen printing apparatus.

Referring generally to FIGS. 1–3, an intelligence pattern is formed by use of well-known techniques on a screen 10, typically made of a fabric such as nylon, that is stretched and secured to a surrounding screen frame, generally indicated by 11. The stretched screen and frame is then secured in a master frame or chase 12, typically made of metal and having screw clamps 14 to engage the edges of the screen frame 11, thus securely holding the frame 11 in place so as to prevent the movement of the screen 10. The chase 12 and screen 10 overlie a printing bed, which herein is in the form of a palette 15 supported on a rotatable support frame or table 13. The item to be printed is placed on the pallet 15 and the chase 12 is brought into registration therewith to place the screen 10 in contact with the item to be printed. Ink or the like is then placed on the upper side of the screen 10 and forced therethrough onto the surface of the item to be printed in accordance with the intelligence pattern on the screen 10 by means of a squeegee. The illustrated table 13 also supports a rotatable drum **13*a* to which four chase assemblies 12*a–d* are pivotally attached. Accordingly, an operator will stand at one palette, manually print one color, pivot the chase 12 upwardly, and then rotate the drum 13*a*** to position the next screen into position to be pivotally lowered into registration with the palette for the printing of the next color.

For smaller jobs, squeegees are usually hand-held. Consequently, as with any manually-performed activity, variations from one print to the next are more likely to occur due to lack of consistency between consecutive printing operations of one person, or from differences resulting in different operators. Typically, the difficulty is in maintaining a uniform pressure across the length of the squeegee blade. The pressure the squeegee exerts to force the ink through the screen is a function of both the angle of the squeegee with respect the print surface as well as the downward force exerted on the squeegee. The closer the squeegee blade angle is to vertical, the more pressure can be placed on the screen to force ink therethrough. Automation or mechanization of the printing stroke has resulted in a greater consistency in the printed product, but at a substantially greater cost.

Figure 4:
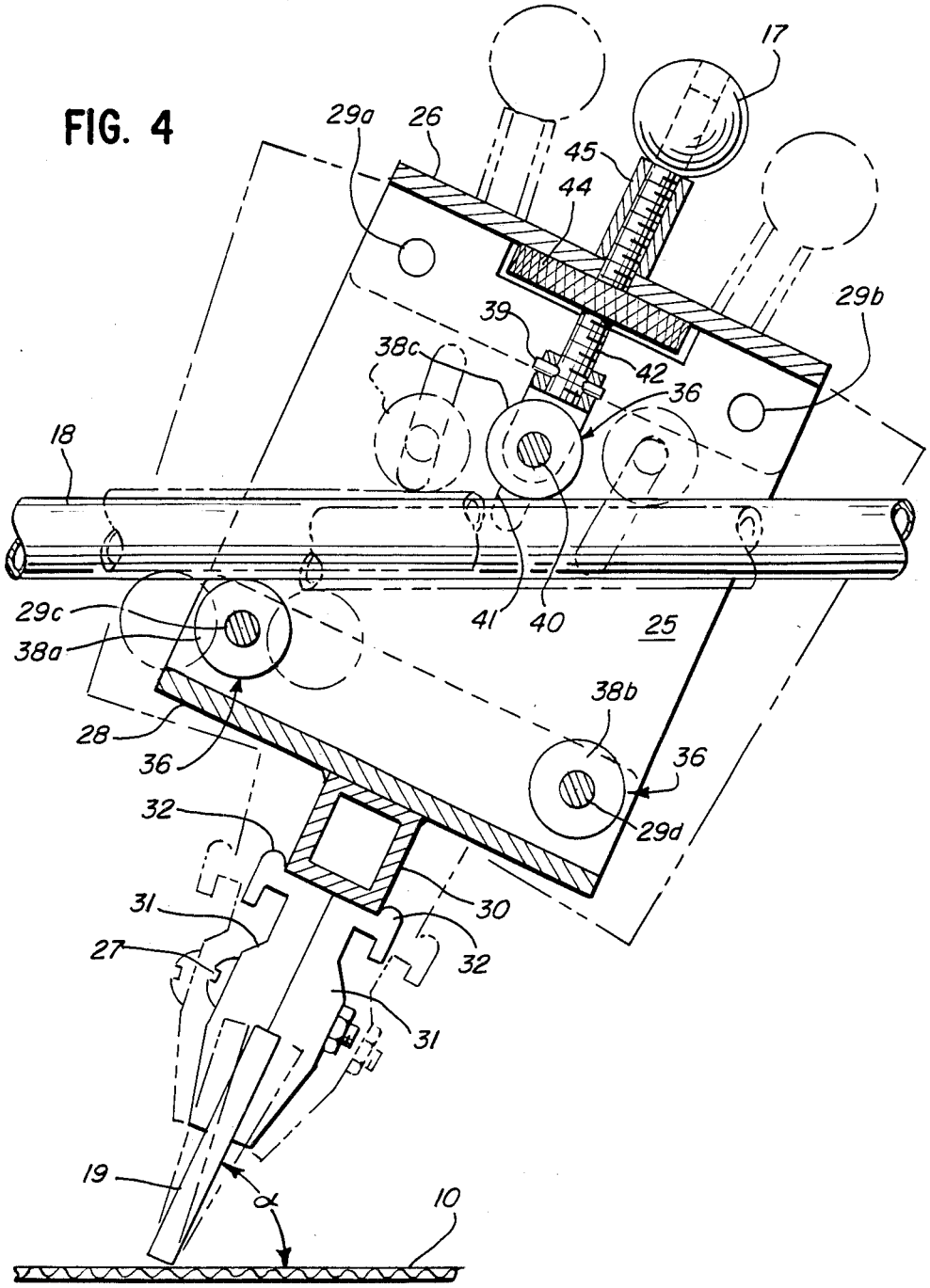
FIG. 4 is an enlarged side elevation of the carriage means of the inventive screen printing apparatus illustrating in phantom the angular adjustability of the squeegee blade with respect to the screen.

In the conventional manually-operated silk screen printing apparatus generally of the kind illustrated herein, the squeegee 9 is mounted to slide along a pivotably mounted lever 18 with the operator placing his hands on top of the squeegee on opposite sides of the lever and pushing and pulling the squeegee along the lever in the flood and print strokes. The operator may place more pressure on the squeegee with his right or left hand than with the other hand and the result will be non-uniform printing because the hand exerting the greater pressure will be forcing more ink through the screen thus providing darker printing than the printing done by the squeegee side having the lesser pressure. Also, in this conventional printer, the operator is free to pivot the squeegee through various angles of incidence to the vertical, as illustrated in FIG. 4, during a flood or print stroke. If the operator varied this angle substantially, the pressure of the squeegee and the amount of ink forced through the screen also varied during the course of the stroke, resulting in lighter or darker printing. The two-handed operation requires operator vigilance and attention and results in fatigue which lowers production rates. Of course, nonuniformly printed patterns on T-shirts are failures which must be scrapped or reworked.

In accordance with the present invention, substantially uniform pressure across the squeegee blade at the screen is attained and a substantially constant angle of incidence to the screen is maintained during the length of the flood and print strokes to produce more uniform prints. Additionally, the carriage may be pushed and pulled through its print and flood strokes with one hand and with the operator merely flipping the squeegee carriage assembly 16 between the print and flood positions, such as shown in FIG. 3, thereby resulting in a more smooth squeegee action with less operator controlling action needed and a consequent reduction in fatigue. This is accomplished by a unique use of a single handle or "joystick" 17 which the operator grasps to push or pull the squeegee assembly toward or from himself and uses to swing the squeegee 9 between flood stroke and print stroke inclinations to the vertical. Also, as will be explained in greater detail, the squeegee carriage assembly is centered on the screen so that equal pressure is applied to the screen by the squeegee on its left and right halves relative to the center of the screen. The preferred mechanism comprises a single three-point action achieved at a low cost. Moreover, the angle of the squeegee blade to the screen can be quickly adjusted by the operator and maintained at this adjusted angle, as will be explained hereinafter in connection with the illustration of such an adjustment in FIG. 4.

Referring in more detail to the drawings, a squeegee/carriage assembly, generally indicated by 16, is movable along the lever arm 18 which also functions as a guide or track 18 for the squeegee blade 19 across the screen 10. As seen in FIG. 3, the lever arm 18 is approximately the same length as the frame 11. When viewed from above, the squeegee blade 19 is disposed perpendicularly to the guide track 18 and centered along its length with respect to the guide track 18 and the carriage assembly 16 as well as to the chase 14 and screen thereon. Consequently, when any force is placed upon the carriage 16, through the handle means 17, it is transmitted to the squeegee blade 19 through a single point in the center thereof to uniformly distribute the force along the length of the squeegee blade 19.

It will be appreciated in other forms of the invention that the support functions and the guide track functions provided by the single lever arm 18 may be separated. For example, one or more guide tracks could be on separate elongated members extending parallel to the pivot support arm for the squeegee holder.

As illustrated, the guide track 18 is centered over the chase 12 and secured by means of an upstanding bracket 20 to the chase support frame 23 to maintain the guide track 18 in rigid longitudinal relation across the center of the screen 10 that is held within the chase 12. Herein, this lever arm or guide track 18 is in the form of a cylindrical tube with an outside diameter of approximately $\frac{3}{4}$ inch, and having a pivot block 21 welded at the end thereof. The pivot block 21 permits the lever arm 18 to be pivotally supported at its inner end between the two plates 22 that constitute the bracket 20. As illustrated, the plates 22 are secured together by bolts 24*a–b*, with bolt 24*a* providing the pivot pin for the lever arm 18. Accordingly, the lever arm 18 is pivotable in a plane perpendicular to the surface of the screen 10, the plane bisecting the chase and the screen thereon. This feature centers the contact of the squeegee blade 19 with the screen 10 regardless of the angle of incidence of the blade 19 with respect thereto, as will be discussed subsequently. By grasping the outer free end of the lever arm 18, the latter and the squeegee carriage assembly thereon can be pivoted upward out of the way.

In accordance with another aspect of the invention, the squeegee blade/carriage assembly 16 is movable along the guide track 18 to provide both a print stroke and a return stroke of the squeegee blade 19. Further, the carriage permits the squeegee to be rotated over center to maintain the proper angle of the squeegee blade 19 with respect to the screen 10 for both the print and flood strokes, as shown in phantom in FIGS. 1 and 3.

Referring more particularly to FIGS. 3 and 4, the carriage 16 comprises two side plates 25 that, along with upper and lower channel members, 26 and 28, respectively, form the housing for the carriage 16. The side plates 25 and channel members 26, 28 are secured together by bolts 29*a–b* extending through the housing adjacent the corners of the side plates 25. Integral with and perpendicular to the lower channel member 28 is a square tube member 30, which facilitates attachment of the squeegee blade 19 to the carriage 16. As illustrated, the upper portion of the squeegee blade 19 is clamped along its length between two holder members 31 that, when screwed together as at 27, form an I-shaped section 32 at the upper end thereof. The I-shaped section 32 is received in the complementary-shaped open ends of the U-shaped clamps 34. Such clamps 34 serve to removably secure the squeegee blade 19 to the tube 30 by means of finger screws 35.

To facilitate movement of the carriage along the guide track surface on the lever arm 18, bearing surfaces 36 are provided on the carriage for engagement with the track 18. In the illustrated embodiment, the bearing surfaces 36 comprise roller bearings 38*a–c* arranged to form the vertices of an isosceles triangle so that roller bearings 38*a* and 38*b* form the base and underlie the guide track 18, while roller bearing 38*c* is disposed over the track and is centered with respect to the base. As illustrated, the roller bearings 38*a, b* are carried on the bolts 29*c, d* that secure the lower end of the carriage housing together. As best seen in FIG. 3, this three point or triangular relation of the bearing surfaces 36 permits the carriage, and consequently the squeegee blade 19, to be rocked back and forth in response to stroke actions in the opposite directions along the track 18. Because the bearings 38 form an isosceles triangle, the angle of the squeegee blade 19 with respect to the screen 10 is substantially identical for both the print and return or flood strokes. While it is preferred that a single joystick handle be used for both pivoting the squeegee blade 19 between the opposite print and flood stroke inclinations and applying the longitudinal force to move the carriage along the lever arm, these functions may also be separated. For example, if four bearings were provided with two above the lever arm and two below to hold the carriage housing at a fixed angle, the squeegee blade could be pivoted onto the carriage housing to swing relative thereto between its opposite print and flood angles. The handle 17 attached to the carriage housing will still slide it along the lever arm. Thus, it will be seen that the bearing surfaces 36 could be arranged so as to maintain a constant angular relation of the carriage housing with respect to the lever arm 18, while the squeegee blade 19 is pivotally attached to the carriage housing 16 to permit it to swivel between the two angles for strokes in opposite directions.

In keeping with another aspect of the invention, it is desirable to provide a means for adjusting the angle of the squeegee blade 19 with respect to the screen surface 10. Varying this angle permits the operator to adjust the amount of flexure of the squeegee blade 19, and, consequently, the pressure placed on the screen surface. With reference to FIG. 4, the smaller the angle $\alpha$ between the squeegee blade 19 in its unflexed condition and the screen 10, the greater the amount of flexure of the blade upon application of pressure on the carriage assembly 16. This results in less of total pressure that is applied to the carriage from being applied to the screen 10. Conversely, the closer the angle $\alpha$ approaches being perpendicular to the screen 10, the greater the direct compressive force that is transmitted from the carriage assembly 16 to the squeegee blade 19.

To facilitate adjustment of the angle $\alpha$, means are provided internally of the carriage housing which change the angle of the carriage housing with respect to the guide track 18. In the illustrated embodiment, this is accomplished by adjusting the distance between the roller bearings 38*a–c* through which the guide track 18 passes as the carriage moves back and forth thereon. Referring more particularly to FIG. 4, the roller bearing 38*c* is adjustable in a perpendicular direction with respect to the roller bearings 38*a, b*. Accordingly, the roller bearing 38*c* is supported on a retaining fork 39 by means of a means of a pin 40 whose ends extend beyond the fork 39 and are captured in slots 41 in the side plates 25 of the carriage 16. The retaining fork 39 is mounted on a threaded shaft 42 that receives a thumb screw 44 underlying the upper channel member 26. The thumb screw 44 is sized in diameter to extend outwardly of the side plates 25 so as to facilitate easy manipulation thereof. To adjust the position of the roller bearing 38*c*, the thumb screw 44 is simply rotated to move the retaining fork 39 up or down within the carriage with the ends of the pin 40 sliding along the parallel sides of the slot. The length of the slots 41 limits the travel of the roller bearing 38*c*. Moving the roller bearing 38*c* downward decreases the distance between the bearings 38*a–c* and increases $\alpha$ up to 90°; conversely, moving the roller bearing 38*c* upward within the carriage 16 decreases the angle $\alpha$.

Once the desired angle $\alpha$ has been obtained, it is desirable to lock the roller bearing 38*c* with respect the carriage 16 so that the angle is maintained. In the illustrated embodiment, this is accomplished by fitting a sleeve 45 that rests on the top of the upper channel member 26 so as to encase that portion of the threaded shaft 42 that extends out from the carriage 16. The handle 17 has a threaded bore extending partially therethrough so as to be received on the portion of the threaded shaft 42 extending above the sleeve 45. Once the desired location of the roller bearing 38*c* is attained, the bearing 38*c* is locked into place by screwing the handle 17 down so as to tightly abut the upper end of the sleeve 45, thus forcing the thumb screw 44 to move upward into frictional engagement with the lower surface of the upper channel member 36. With the thumb screw abutted tightly against the underside of the channel member 26, manipulation of the thumb screw 44 is prevented, thus preventing unintentional movement of the bearing 38*c*. To adjust the position of the roller bearing 38*c*, the handle member 17 is unscrewed so as to move out of engagement with the upper end of the sleeve 45, thus releasing the thumb screw 44 from frictional engagement with the lower surface of the upper channel member 36. The thumb screw 44 may then be rotated to achieve the desired position of the roller bearing 38*c*.

From the foregoing, it can been seen that a new and improved screen printing apparatus has been provided that facilitates a smooth, even squeegee action across the screen with a minimum of exertion. Although the invention has been described in terms of a preferred embodiment, it is not intended to limit the invention to the same. On the contrary, it is intended to cover all modifications within the scope of the appended claims.

What is claimed is:

1. In a manually operated screen printing apparatus, the combination comprising:

a printing bed for holding a substrate to be printed, a screen holding means and a screen mounted therein over the printing bed for printing onto the substrate, a squeegee blade for engaging the screen in flood and print strokes for forcing ink or the like through the screen to print onto the substrate, a squeegee carriage means for carrying the squeegee blade back and forth across the screen through the print and flood strokes, means mounting the squeegee blade at a first inclination during a print stroke and a second inclination for flood stroke, and track means centered with respect to the centerline of the screen for guiding the carriage for rectilinear movement during the print and flood strokes and to center the squeegee blade and carriage over the screen, said squeegee blade being pivotally mounted with respect to said track means, means for pivotally mounting said track means for swinging in a lift direction to move said squeegee blade into and from contact with said screen, and an operating handle on the carriage means for grasping by the operator to manually move the squeegee carriage means along the track means in a direction parallel to the track means and the lift direction, said operating handle being centered over the track means and the center of the screen so as to apply equal force to the squeegee blade halves on opposite sides of the screen centerline.

2. An apparatus in accordance with claim 1 in which the track means comprises an elongated lever pivoted at one end and extending along the center line of the screen to a free end which can be lifted to raise the squeegee from the screen.

3. An apparatus in accordance with claim 2 in which the carriage means comprises three bearing surfaces formed in a triangular arrangement, a first one of said bearing surfaces engaging the track means only in the print stroke, a second one of the bearing surfaces engaging the track means only in the flood stroke, and the third one of the bearing surfaces engaging the track means in both the print and flood strokes.

4. An apparatus in accordance with claim 3 in which at least one of said bearings is selectively movable in the carriage means to adjust the angle of inclination of the squeegee to the screen.

5. A manually operated screen printing mechanism comprising:

a printing screen having a centerline therethrough and pivotally mounted to turn about an axis, a lever pivotally mounted at one end over the centerline of the screen and having a free end to be lifted relative to the screen for swinging in a lift direction, said lever being perpendicular to said axis for said screen, a squeegee carriage mounted on the lever for reciprocating rectilinear movement in a direction parallel to the lever and carrying a squeegee to engage the screen with substantially equal pressure on opposite sides of the lever, a three point bearing means on said carriage mounting the carriage to slide along the lever and to hold the squeegee at opposite angles of inclination to the vertical during the print and flood strokes, a handle mounted on the squeegee carriage for grasping by the operator to push and to pull the squeegee carriage and to flip the carriage between the print stroke inclination and the flood stroke inclination.

6. An apparatus in accordance with claim 5 in which the handle includes a ball mounted on top of the carriage for grasping with one hand and said lever is an elongated rod, an outer surface on the rod serving as a track for sliding engagement with the bearings.

7. A manually operated screen printing mechanism comprising, a printing screen having a centerline therethrough, a lever pivotally mounted at one end over the centerline of the screen and having a free end to be lifted relative to the screen, a squeegee carriage mounted on the lever for reciprocating rectilinear movement and carrying a squeegee to engage the screen with substantially equal pressure on opposite sides of the lever, a three point bearing means on said carriage mounting the carriage to slide along the lever at opposite angles of inclination to the vertical during the print and flood strokes, a handle mounted on the squeegee carriage for grasping by the operator to push and to pull the squeegee carriage and to flip the carriage between the print stroke inclination and flood stroke inclination, said handle including a ball mounted on top of the carriage for grasping with one hand, said lever being an elongated rod, an outer surface on the rod serving as a track for sliding engagement with the bearings, said three point bearing means comprising a first bearing for engaging a first side of the rod in both the flood and print strokes and second and third bearings located to engage the opposite side of the rod, said first, second and third bearings being arranged in a triangular array, said second bearing engaging the rod in the flood stroke and the third bearing engaging the rod in the print stroke.

8. An apparatus in accordance with claim 7 including means on said carriage for shifting the first bearing relative to the other bearings so as to change the angle of the carriage and the squeegee relative to the vertical and to the printing screen.

9. A manually operated screen printing apparatus comprising, a printing bed supported on a frame to receive a substrate, a chase means and a screen for receiving ink in alignment with and overlying the printing bed to print onto the substrate, said screen being pivoted to turn about an axis, and a squeegee assembly associated with the screen comprising track means overlying the screen and centered with respect to the screen, said track means being centered on the screen means, said track means being perpendicular to said axis of said screen, carriage means movable along the track means in a direction parallel to the track means, squeegee blade means for contacting the screen secured to the carriage means and centered in perpendicular relation along its length to the track means, a handle means on the carriage means centered over said track means to be grasped by one hand for moving the carriage and the squeegee blade means through a predetermined angle with respect to an axis perpendicular to the surface of the screen as the carriage means moves on the track means to cause the squeegee blade means to travel across the screen in response to manual actuation while grasping the handle means, said squeegee blade means having fixed angles with respect to said perpendicular axis for a flood stroke and a print stroke.

10. The combination of claim 9 wherein the squeegee blade means is fixed to the carriage means and the carriage means is pivotable about an axis perpendicular to the track means and parallel to the plane of the screen to change the angle of the squeegee blade means with respect to the screen.

11. The combination of claim 9 wherein the track means comprises a lever member pivotably attached to the chase means so as to allow engagement of the squeegee blade means with the screen in response to changing of the angle of the squeegee blade means with respect to the stencil screen and the carriage means being pivotable about an axis perpendicular to the track means and parallel to the plane of the screen to change the angle of the squeegee blade means with respect to the stencil screen.

12. The combination of claim 11 wherein the carriage means includes bearing members for engaging the track means so as to facilitate movement of the carriage along the track means, the bearing members being adjustable to permit the angle of the carriage means with respect to the track means to be varied.

13. The combination of claim 12 wherein the bearing members comprise at least three roller bearings carried within the carriage, at least one of the roller bearings movable within the carriage housing with respect to the other roller bearings, two of said roller bearings engaging the track means and another bearing means spaced from the track means in each direction carriage travel.

14. The combination of claim 13 wherein the roller bearings are triangularly oriented with respect to each other, with two stationary roller bearings underlying the track means and one roller bearing overlying the track means being mounted for movement with respect to the carriage means so as to vary the distance between the movable roller bearing and the stationary roller bearings, and means for locking the movable roller bearing with respect to the carriage means.

15. The combination of claim 14 wherein the surfaces of the roller bearings that engage the track means form the vertices of an isosceles triangle, the roller bearing overlying the track means being substantially equidistantly spaced from each of the roller bearings underlying the track means.

* * * * *